US008122920B2

(12) United States Patent
Eberle-Rubo

(10) Patent No.: US 8,122,920 B2
(45) Date of Patent: Feb. 28, 2012

(54) BEVERAGE CONTAINER TAPPING APPARATUS

(75) Inventor: Gisela Eberle-Rubo, Baden-Baden (DE)

(73) Assignee: SafeClean EDE GmbH, Erfurt (DE)

( * ) Notice: Subject to any disclaimer, the term of this patent is extended or adjusted under 35 U.S.C. 154(b) by 0 days.

(21) Appl. No.: 12/543,591

(22) Filed: Aug. 19, 2009

(65) Prior Publication Data

US 2010/0032024 A1 Feb. 11, 2010

Related U.S. Application Data

(63) Continuation of application No. PCT/EP2008/001301, filed on Feb. 20, 2008.

(30) Foreign Application Priority Data

Feb. 21, 2007 (DE) ..... 10 2007 008 883

(51) Int. Cl.
*B67C 3/26* (2006.01)

(52) U.S. Cl. ..... 141/284; 141/91; 141/95; 222/325

(58) Field of Classification Search ..... 141/85, 141/89, 90, 91, 94, 95, 269, 279, 284, 351–353, 141/363, 129; 222/400.7, 400.8, 128, 325, 222/18

See application file for complete search history.

(56) References Cited

U.S. PATENT DOCUMENTS

| | | | | |
|---|---|---|---|---|
| 4,102,450 | A * | 7/1978 | Chapman et al. | 198/774.2 |
| 5,000,661 | A | 3/1991 | Bloch et al. | |
| 5,285,825 | A * | 2/1994 | Townsley | 141/9 |
| 5,662,226 | A * | 9/1997 | Till | 209/2 |
| 7,014,713 | B2 * | 3/2006 | Nakane | 118/300 |
| 7,224,273 | B2 * | 5/2007 | Forster | 340/539.1 |
| 2004/0231749 | A1 | 11/2004 | Goldin | |
| 2004/0245281 | A1 * | 12/2004 | Oke | 222/1 |
| 2005/0188651 | A1 * | 9/2005 | Clusserath | 53/136.1 |

FOREIGN PATENT DOCUMENTS

| | | |
|---|---|---|
| DE | 7208627 | 3/1972 |
| EP | 0 363 768 | 4/1990 |
| FR | 2 779 333 | 12/1999 |

* cited by examiner

*Primary Examiner* — Gregory Huson
*Assistant Examiner* — Jason Niesz
(74) *Attorney, Agent, or Firm* — Harness, Dickey & Pierce, P.L.C.

(57) ABSTRACT

The invention relates to a beverage container tapping apparatus, with:

a transporting device for transporting beverage containers from an introducing position to a first and a second position, a disinfecting device for disinfecting a beverage container fitting, said disinfecting device being assigned to the first position, a tap head device with a tap head and a unit for attaching the tap head to the fitting of a beverage container, wherein the tap head device is assigned to the second position, and a device for transporting a beverage container out of the second position into an empties region.

18 Claims, 3 Drawing Sheets

BEVERAGE CONTAINER TAPPING APPARATUS

CROSSREFERENCE TO RELATED APPLICATIONS

This application is a continuation of copending international application PCT/EP2008/001301 filed on Feb. 20, 2008 and designating U.S., which was published in the German language and claims priority of German patent application DE 10 2007 008 883.5 filed on Feb. 21, 2007. The entire contents of these applications are incorporated herein by reference.

BACKGROUND OF THE INVENTION

The present invention relates to a beverage container tapping apparatus.

Nowadays, in the catering trade, beverages, such as beer, etc., are supplied in standard barrel-shaped beverage containers which are stored either in the bar area itself or away from the bar counter, for example in the cellar. In order to join a beverage container to the bar system, a tap head is placed by the user onto the beverage container and locked. This causes the beverage container to be pierced and connected to the bar system.

In order to be able to continue to draw liquids over a relatively long period of time, there are in the meantime systems which have a plurality of tap heads, each of which is connected to a beverage container. As soon as a beverage container is empty, a switch can then be made virtually without any delay to the next beverage container such that the bar system continues to be supplied with the desired beverage.

Although said systems have proven successful in practice, there is, of course, still the need to further simplify the operation so as to take some of the load off the user.

SUMMARY OF THE INVENTION

Against this background, it is the object of the present invention to provide a beverage container tapping apparatus which permits significantly simpler handling.

This object is achieved by a beverage container tapping apparatus which has:

a transporting device for transporting beverage containers from an introducing position to a first and a second position, a disinfecting device for disinfecting a beverage container fitting, said disinfecting device being assigned to the first position, a tap head device with a tap head and a unit for automatically attaching the tap head to the fitting of a beverage container, wherein the tap head device is assigned to the second position, and a device for transporting a beverage container out of the second position into an empties region.

That is to say, in other words, a beverage container tapping apparatus which permits fully automatic handling of beverage containers is provided. The beverage containers are transported by a transporting device to a first position in which the fitting of the beverage container is disinfected. They are subsequently transported to the second position in which a tap head is automatically placed onto the fitting of the beverage container and therefore the beverage container is pierced. The beverage is then conveyed via corresponding beverage lines to a bar system. Finally, a device ensures that an empty beverage container is transported out of the second position into an empties region. It should be noted at this juncture that the first and second positions may also coincide.

The beverage container tapping apparatus according to the invention consequently makes it possible for the user to no longer have to place tap heads onto the beverage containers manually. It is possible for fresh beverage containers to be supplied directly to the transporting device and for the empty beverage containers to be removed from the empties region such that the user is no longer obliged at all to go to the relevant storage space in order to pierce the beverage containers.

It can readily be seen that the user obtains a considerable advantage as a result, since he has significantly less work than in the case of the previous tapping apparatuses.

In a preferred development, the transporting device is designed in such a manner that there is space for a plurality of beverage containers between the introducing position and first position.

This measure has the advantage of providing a beverage container store which enables the particular beverage to be supplied for a relatively long period of time without restocking. This is advantageous in particular where there are great delivery distances to the particular catering trade businesses. Transporting costs can be saved as a result of a greater stock of beverage containers.

In a preferred embodiment, the disinfecting device has a means for pulling off a protective cap of the beverage container.

This measure has the advantage of making a further simplification of the operation possible, since a further necessary step for piercing a beverage container is carried out automatically.

In a preferred development, the disinfecting device and tap head device are located below the beverage containers which, for their part, are transported upside down.

That is to say, in other words, the beverage containers rest with their fittings downward on the transporting apparatus, and the tap head device is then moved upward from below in order to pierce the particular beverage container.

This measure has the advantage of enabling a virtually residue-free emptying of the beverage container.

In a preferred development, a pair of scales is provided in the region of the second position in order to record the weight of the beverage container and therefore the filling level thereof.

This measure has the advantage of it being possible in a simple manner to record when the beverage container is empty. A fully automatic exchange of beverage containers can therefore be carried out without the user having to intervene, for example by actuating a button on the bar system for an exchange of beverage containers.

In a preferred development, an identification unit which records the beverage-container-specific data and the number of beverage containers on the transporting device is provided in the region of the introducing position. The identification unit preferably has a transponder reader which can read out the transponders provided on a beverage container.

This measure has the advantage that beverage-container-specific data, such as the type of beverage, quantity of beverage contained, etc., can be read out and then processed. By reading out the quantity of beverage the weight at which the beverage containers are empty can be established. The identification of the type of beverage can be used, for example, to employ certain cleaning agents in a cleaning system in order to clean the beverage lines.

A control device which is preferably designed as a PC unit is provided in order to use all of the information and to control the processes within the beverage container tapping apparatus.

The control device preferably has a network interface for communication via the Internet.

This measure has the advantage that a connection to a logistics center/beverage supplier can be established so as to exchange data. Via this route, it is therefore conceivable for the beverage container tapping apparatus to automatically reorder beverage containers when the stored beverage containers are running low. Of course, it is conversely also possible for the beverage supplier to read out the stock by making a remote inquiry and, with reference thereto, to decide whether a delivery is necessary.

In a preferred development, a card reader is provided, said card reader being connected to the control device and being designed to undertake payment operations with the aid of a card, in particular a cash or credit card.

This measure has the advantage that invoicing and payment are possible directly in situ. If the beverage container tapping apparatus comprises a housing which completely surrounds the transporting device, in which the beverage containers can be introduced via an input opening and can be discharged via an output opening, the beverage supplier can initially supply stock to the customer without payment, and then the customer only pays for a beverage container, for example via the card reader, when said container is pierced. All of the other beverage containers contained in the sealed housing belong to the beverage supplier and have not yet been paid for by the customer.

This measure has the advantage of enabling transport costs to be saved particularly when catering trade businesses are far away without placing a financial burden on the user because of a relatively large stock.

In a preferred development, in the region of the second position, the transporting device has two parallel transporting sections which are constructed identically to each other such that two beverage containers can be pierced at the same time.

That is to say, in other words, each of the two transporting sections is assigned a tap head device, wherein a beverage container is immediately pierced when the other beverage container is empty. This prevents the period of time between removal of the tap head, transporting away the empty beverage container and supplying and piercing a new beverage container from interrupting the supply of beverage.

In a preferred development, a cooling device which cools the interior space surrounded by the housing is provided.

This measure has the advantage of improving the possibility of use.

In a preferred development, a cleaning system for beverage lines is provided.

This measure also ensures an improvement and simplification of the possibility of use of the beverage container tapping apparatus according to the invention.

A further improvement is achieved by the transporting device being of modular construction such that the distance between the introducing position and first position and therefore the holding capacity for beverage containers can be extended.

The object on which the invention is based is also achieved by a beverage container tapping apparatus with:

a region for storing a multiplicity of beverage containers arranged in one or more rows, a disinfecting device for disinfecting a beverage container fitting, a tap head device with a tap head and a unit for automatically attaching the tap head to the fitting of a beverage container, and a transporting device which is assigned to the disinfecting device and/or the tap head device and is designed in order to bring said two devices in a two-dimensional plane over one of the multiplicity of beverage containers such that disinfection or tapping of the beverage container located therebelow is subsequently possible.

In contrast to the previous solution, in this refinement, the beverage containers are not moved to the tap head device but rather, conversely, the tap head device is moved to the particular beverage container. The beverage containers themselves stand upright in a storage region below the transporting device which moves at least the tap head device in a two-dimensional plane above the beverage containers.

It should be noted at this juncture that a combination of individual features of the two solutions is also possible. For example, it would be conceivable to distribute the beverage containers via a central inlet "in the manner of a matrix" within a housing.

Further advantages and refinements of the invention emerge from the description and the attached drawing.

It goes without saying that the features mentioned above and those which have yet to be explained below can be used not only in the respectively stated combination but also in different combinations or on their own without departing from the scope of the present invention.

BRIEF DESCRIPTION OF THE DRAWINGS

The invention is explained in more detail below using exemplary embodiments and with reference to the drawing, in which.

DETAILED DESCRIPTION OF PREFERRED EMBODIMENTS

Figure 1:
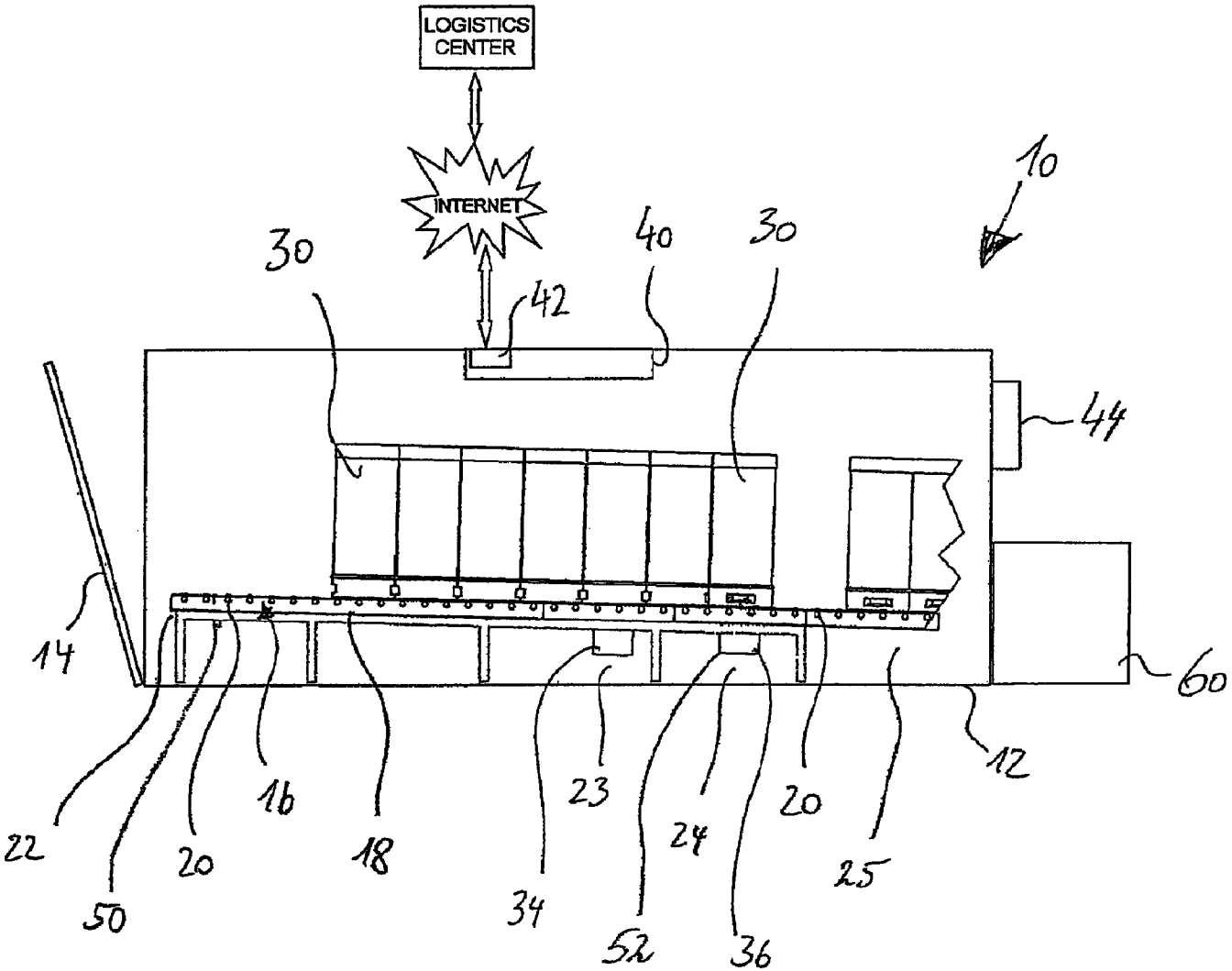
FIG. 1 shows a schematic illustration of a beverage container tapping apparatus according to the invention.

The beverage container tapping apparatus is shown in FIG. 1 in a schematic illustration from the side and is identified by the reference number 10.

The beverage container tapping apparatus (called tapping apparatus below for short) comprises a housing 12 which has side walls and a base and a cover. A flap 14 is provided at one end of the housing 12 in order to gain access to the interior space of the housing from one longitudinal side. A flap, which is not illustrated, however, for reasons of clarity, can likewise be provided on the opposite longitudinal side. As an alternative, a closable opening can also be provided at the opposite end on the upper side of the housing 12.

A transporting device 16 which extends substantially over the entire length of the housing 12, i.e. from the flap 14 to the opposite end in FIG. 1, is provided within the housing 12. The transporting device 16 rests on a frame (only illustrated schematically) and forms a transporting plane 18 which, in the present exemplary embodiment, is somewhat inclined (relative to the floor surface). That is to say, in other words, the transporting plane 18 drops slightly from the flap 14 in the direction of the opposite side.

The transporting device in the transporting plane 18 comprises a multiplicity of transporting rollers 20 which are arranged in parallel and enable a product lying thereon to be conveyed from the flap 14 to the opposite side.

A motor for conveying or transporting the products resting on the transporting plane 18 can be omitted because of the provided inclination of same. Gravitational force alone is sufficient in order to move the product from the left to the right. Of course, it is alternatively or as an accompaniment entirely conceivable also to provide a drive such that at least some of the transporting rollers are driven.

The transporting device 16 serves to convey beverage containers 30 from an introducing position 22 in the region of the flap 14 to a first position 23, then to a second position 24 and finally to a discharging position 25.

A disinfecting device 34 which disinfects a fitting of the beverage container 30 located thereabove is provided at the first position 23. It should be noted here that the beverage containers 30 stand with their fitting side downward on the transporting device 16. Since the fittings of the beverage containers 30 are customarily provided with a protective cap, the disinfecting device 34 also has the task of pulling off said protective cap.

Of course, the last-mentioned function, i.e. the pulling off of the protective cap, can also be carried out at a different position between the introducing position 22 and first position 23.

A tap head device 36, the construction of which will be described in detail further on, is provided in the second position 24. In principle, said tap head device has the object of placing a tap head onto the fitting and of piercing the beverage container such that the beverage contained in the beverage container 30 can be supplied via corresponding beverage lines to a tap installation.

In addition, a pair of scales 52 which records the weight of the pierced beverage container 30 in order to use said information to determine the current degree of filling of the beverage container 30 is provided in the second position 24.

Finally, a device—not illustrated—which transports the empty beverage container 30 out of the housing 12 into an empties region is provided in the discharging position 25. Of course, it would also be conceivable to provide said empties region within the housing 12.

In order to record beverage-container-specific data and the number of beverage containers 30 located on the transporting device, a transponder reader 50 which reads out the transponders assigned to the beverage containers 30 is provided in the introducing position 22.

In order to record and process said data, the beverage container tapping apparatus 10 has a control device 40 which is electrically connected to the disinfecting device 34 and the tap head device 36 and also to the transponder reader 50. The control device 40, which may be designed as a customary PC, monitors and controls the transporting and tapping processes within the housing 12. For reasons of simplification, the required data lines between the control device 40 and the respective readers are not illustrated in FIG. 1.

The control device 40 comprises an interface 42, for example an Ethernet interface, in order to permit a connection to the Internet. Said data path can be used—depending on the application—to communicate with a logistics center or with the actual beverage supplier.

The tapping apparatus 10 according to the invention furthermore comprises a card reader 44 which is attached to the outer side of the housing 12 and serves to record bank cards or credit cards in order to be able to use them to carry out payment operations. However, the card reader 44 is not a necessary element but rather is or is not provided, depending on the application.

Finally, the tapping apparatus 10 shown in FIG. 1 also has a cooling unit 60 which cools the interior space of the housing 12 such that the beverage containers 30 located therein are at the correct, desired temperature. Said subassembly is not a necessary part of the tapping apparatus 10 either but rather is provided depending on the application.

The apparatus shown in FIG. 1 is operated as follows:

First of all, a beverage supplier, after opening the flap 14, will place full beverage containers onto the transporting device 16 upside down, i.e. with the fitting downward. The sloping transporting plane 18 causes the introduced beverage containers 30 to slide to the right—in FIG. 1—in the direction of the first and second positions 23, 24. As said containers pass the introducing position 22, the beverage-specific data stored in the particular transponder of the beverage container are recorded via the transponder reader 50 and transmitted to the control device 40. The transport is interrupted at the first position 23 such that the beverage container furthest to the right (introduced first) comes to stop over the disinfecting device 34.

If the beverage supplier has introduced the desired number of beverage containers 30 into the housing 12, the flap 14 is closed again such that a more or less tight interior space can be cooled via the cooling unit 60.

The beverage container 30 located over the disinfecting device 34 is first of all freed from the protective cap such that disinfection of the fitting is possible. The beverage container 30 is subsequently brought into the second position 24 where tapping of the beverage container 30 can take place with the aid of the tap head device 36. The beverage is then transported via lines—not illustrated—to a bar system.

As soon as the beverage container 30 is empty, a fact which can be established via the pair of scales 52, the empty beverage container 30 is transported into the discharging position 25 from where it is transported on into the corresponding empties region.

The abovementioned operation, i.e. disinfecting of a beverage container fitting, transporting into the second position 24 and tapping via the tap head device 36, is repeated until all of the beverage containers 30 present in the housing 12 are used up, i.e. are empty.

The control device 40 can automatically transmit a message to the logistics center or the beverage supplier via the Internet connection when the beverage container store is running low such that refilling with new beverage containers 30 and transporting away of the empty beverage containers 30 are possible promptly. Of course, it is also conceivable for the actual beverage supplier to enquire about the stock of full beverage containers 30 in the tapping apparatus 10.

Figure 2A:
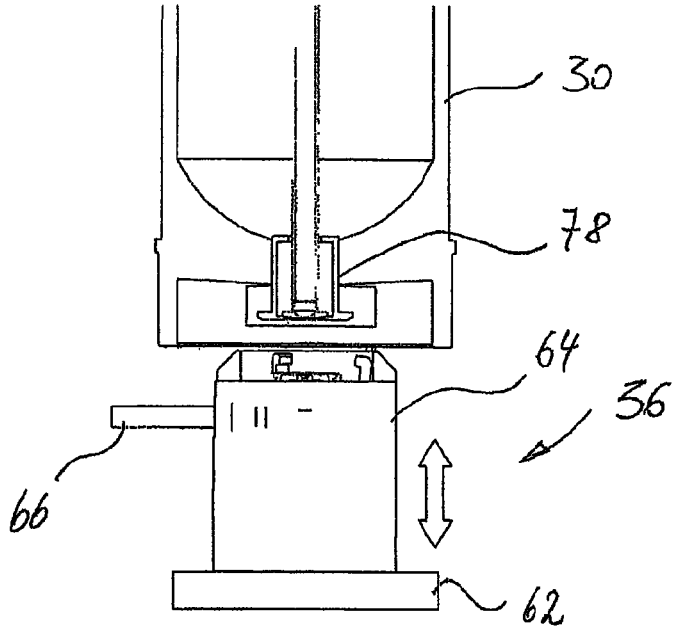
FIGS. 2*a* and 2*b* show schematic side views of a tap head device in the pre-contact and attached states.
Figure 2B:
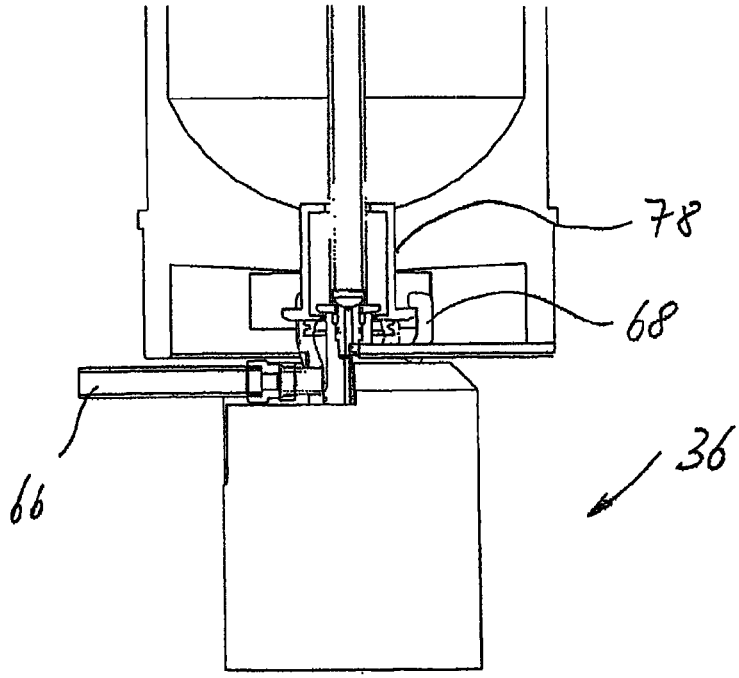

FIGS. 2*a* and 2*b* illustrate the tap head device 36 in detail, to be precise first of all in FIG. 2*a* in the pre-contact position and then, in FIG. 2*b*, in the attached position.

The tap head device 36 comprises a lifting device 62 and a tap head 64. The lifting device 62 serves to move the tap head 64 in the direction of the beverage container 30 located thereabove in order to permit piercing.

The tap head 64 is constructed in a customary manner and therefore does not need to be discussed in more detail here. It always has a beverage line 66 via which the beverage present in the beverage container 30 can be conducted to lines leading on further. Furthermore, the tap head 64 comprises a clamping mechanism 68 which enables it to be locked on a fitting 78 of the beverage container 30.

Figure 3:
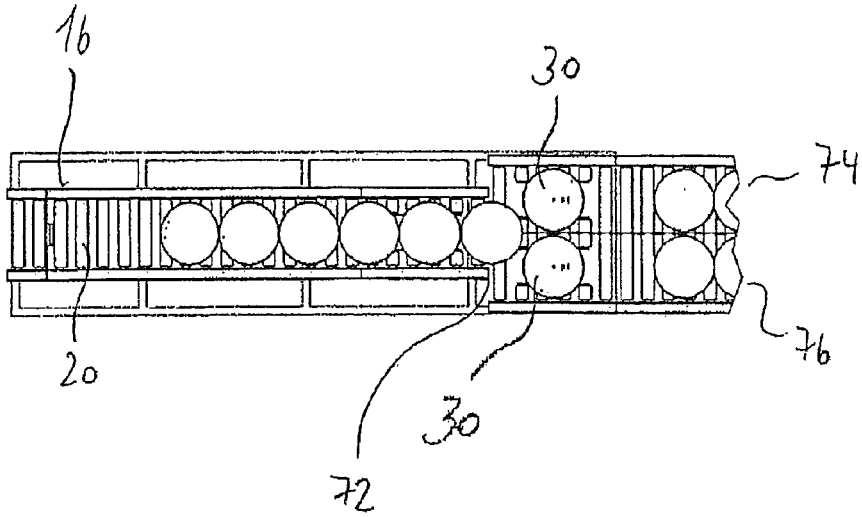
FIG. 3 shows a schematic top view of a transporting device as per a second embodiment.

FIG. 3 illustrates a variant of the tapping apparatus 10 which differs essentially in that a more rapid change of supply from one beverage container 30 to the next is possible. For this purpose, the transporting device is divided, preferably after the first position 23, at a junction 72 into two parallel transporting sections 74, 76, each having a tap head device 36.

Figure 4:
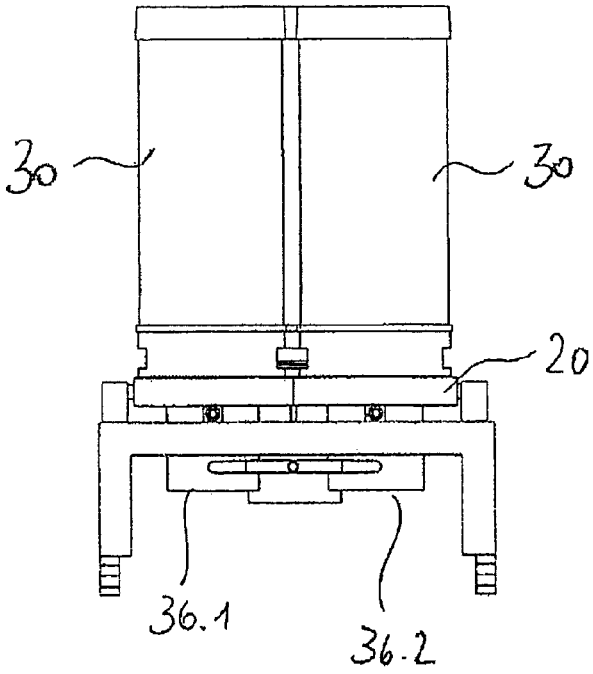
FIG. 4 shows a schematic side view of the transporting device of FIG. 3.

A corresponding illustration in which the two tap head devices 36.1 and 36.2 are shown, is contained in FIG. 4.

The two parallel beverage containers 30 can be pierced simultaneously or alternately, depending on requirements, the control device 40 controlling the operation.

The two parallel subsections 74, 76 are provided with beverage containers 30 in an alternating manner in the junction region 72, this being realized via baffle plates or the like.

Overall, it can be seen that the tapping apparatus 10 according to the invention permits fully automatic operation such that, after the transporting device 16 has been provided with beverage containers 30, a user no longer has to intervene. The apparatus disinfects the fittings and taps the beverage containers 30 in a fully automatic manner. As soon as the beverage containers are empty, they are also transported away automatically into an empties region.

As already mentioned at the beginning, it is also conceivable to reverse the previously described principle insofar as, rather than the beverage container being moved to the disinfecting and tap head devices, the two devices are moved to the stationary beverage containers.

What is claimed is:

1. A beverage container tapping apparatus for automatically handling and tapping filled beverage containers, comprising:

a transporting device for transporting a plurality of beverage containers, each having a beverage container fitting, that are introduced into the tapping apparatus, from an introducing position, to a first position, and to a second position;

a disinfecting device for automatically disinfecting the beverage container fitting of a beverage container located in said first position;

a tap head device with a tap head and a unit for automatically attaching the tap head to the beverage container fitting of a beverage container located in said second position, wherein attachment of the tap head enables withdrawal of beverage from the beverage container; and a device for removing a beverage container from the tapping apparatus after the beverage container is substantially empty.

2. The beverage container tapping apparatus as claimed in claim 1, characterized in that the transporting device is designed in such a manner that there is space for a plurality of beverage containers between the introducing position and first position.

3. The beverage container tapping apparatus as claimed in claim 1, characterized in that the disinfecting device has a means for pulling off a protective cap of the beverage container.

4. The beverage container tapping apparatus as claimed in claim 1, characterized in that the disinfecting device and the tap head device are located below the beverage containers which are transported upside down.

5. The beverage container tapping apparatus as claimed in claim 1, characterized in that a pair of scales is provided in the region of the second position in order to record the weight of the beverage container and therefore the filling level thereof.

6. The beverage container tapping apparatus as claimed in claim 1, characterized in that an identification unit which records the beverage-container-specific data and the number of beverage containers on transporting device is provided in the region of the introducing position.

7. The beverage container tapping apparatus as claimed in claim 6, characterized in that the identification unit has a transponder reader which can read the beverage-container-specific data contained transponders provided on the beverage containers.

8. The beverage container tapping apparatus as claimed in claim 1, characterized in that a control device is provided that is designed to automatically control the transportation and the tapping of the beverage containers.

9. The beverage container tapping apparatus as claimed in claim 8, characterized in that the control device has a network interface for communication via the Internet.

10. The beverage container tapping apparatus as claimed in claim 8, characterized in that the data recorded by a pair of scales are supplied to the control device in order to be used to record the number of empty beverage containers and to pass on said information via the network.

11. The beverage container tapping apparatus as claimed in claim 1, characterized in that, in the region of the second position, the transporting device has two parallel transporting sections which are constructed identically to each other such that tap heads can be attached to two beverage containers at the same time.

12. The beverage container tapping apparatus as claimed in claim 1, characterized in that a housing is provided which completely surrounds the transporting device into which the beverage containers can be introduced via an input opening and can be removed via an output opening.

13. The beverage container tapping apparatus as claimed in claim 12, characterized in that the input and output openings can be closed.

14. The beverage container tapping apparatus as claimed in claim 13, characterized in that a cooling device which cools the interior space surrounded by the housing is provided.

15. The beverage container tapping apparatus as claimed in claim 1, characterized in that a cleaning system for beverage lines is provided.

16. The beverage container tapping apparatus as claimed in claim 1, characterized in that the transporting device is of modular construction such that the distance between the introducing position and first position and therefore the holding capacity for beverage containers can be extended.

17. The beverage container tapping apparatus as claimed in claim 1, wherein the transporting device transports the beverage containers in sequence from the introducing position, to the first position, and then to the second position.

18. The beverage container tapping apparatus as claimed in claim 1, wherein the transporting device further transports a beverage container from said second position to a discharge position after the beverage container is substantially empty and before removal by said device.

* * * * *